United States Patent [19]

Winter

[11] Patent Number: 4,627,124

[45] Date of Patent: Dec. 9, 1986

[54] DEVICE FOR SUPPORTING THE LAST ON A TOE LASTING MACHINE

[75] Inventor: Gerhard Winter, Hauenstein, Fed. Rep. of Germany

[73] Assignee: Schon & Cie. Gesellschaft mit beschrankter Haftung, Fed. Rep. of Germany

[21] Appl. No.: 644,679

[22] Filed: Aug. 27, 1984

[30] Foreign Application Priority Data

Aug. 27, 1983 [DE] Fed. Rep. of Germany ..... 3331020

[51] Int. Cl.[4] ..... A43D 21/08

[52] U.S. Cl. ..... 12/12.4; 12/123

[58] Field of Search ..... 12/12.3, 12.4, 14.2, 12/123, 124, 12.2

[56] References Cited

U.S. PATENT DOCUMENTS

| | | | |
|---|---|---|---|
| 2,094,110 | 9/1937 | Schoenky | 12/12.4 |
| 2,350,849 | 6/1944 | Walther, Sr. | 12/12.4 |
| 2,596,169 | 5/1952 | Proulx et al. | 12/12.4 |
| 3,091,786 | 6/1963 | Vornberger | 12/12.4 |
| 3,365,736 | 1/1968 | McKibbin et al. | 12/12.4 |
| 3,579,690 | 5/1971 | Kamborian | 12/10.5 |
| 3,852,841 | 12/1974 | Schindler et al. | 12/123 |

FOREIGN PATENT DOCUMENTS

| | | | |
|---|---|---|---|
| 489649 | 8/1938 | United Kingdom | 12/12.4 |
| 1580298 | 12/1980 | United Kingdom | 12/123 |

*Primary Examiner*—Werner H. Schroeder
*Assistant Examiner*—Steven N. Meyers
*Attorney, Agent, or Firm*—Wenderoth, Lind & Ponack

[57] ABSTRACT

The invention relates to a device for supporting the last in a toe lasting machine in which the last, with its sole facing down, is supported on a last support and is held with its heel portion on a heel support carrier which can be adjusted to the length of the last and has an abutment face more or less adapted or adaptable to the shape of the heel portion. To prevent tipping moments from acting on the last during lasting, provision is made for the mounting of the heel support carrier to enable it to pivot relative to the last support about an axis which is vertically below the last support. This pivot axis is substantially parallel to the support plane of the last support for the last and is substantially perpendicular to the longitudinal direction of the heel support carrier holding a last which is clamped for a toe lasting operation.

11 Claims, 4 Drawing Figures

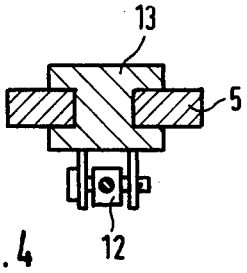
FIG. 4
FIG. 2
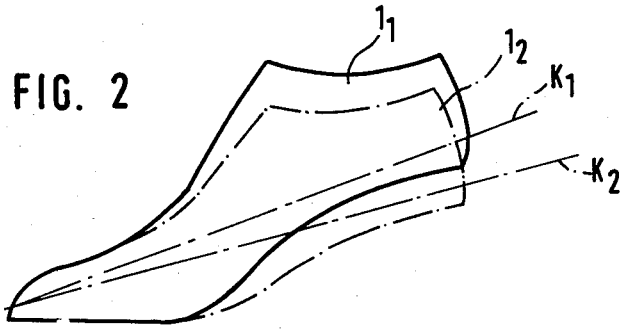
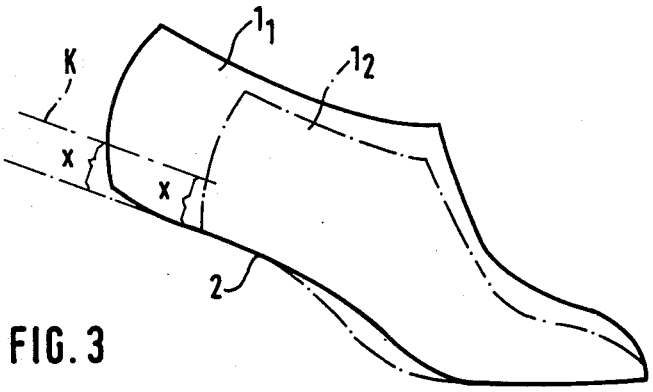
FIG. 3

DEVICE FOR SUPPORTING THE LAST ON A TOE LASTING MACHINE

BACKGROUND OF THE INVENTION

The invention relates to a device for supporting the last in a toe lasting machine during the lasting operation with its sole facing down. The last is carried on a last support and is held with its heel portion on a heel support carrier which can be adjusted to the length of the last and which has an abutment face which can be adapted to the shape of the heel portion.

In such support devices, a force acts on the last during the lasting, preferably in a longitudinal direction so that the force will be absorbed by the heel support. The last support is usually moved in the direction of the heel portion and a force acts upon the last due to the load applied by the wipers on the tip of the last. This load between the tip on the last and the heel portion of the last creates a moment that tends to tip the last upward. Attempts were made to counteract this disadvantageous tipping moment by an appropriate geometric formation of the abutment face of the heel support abutting the heel portion of the last, but this has not always been satisfactory.

Therefore, the main object of the present invention is to provide a device for supporting the last on a toe lasting machine in such a way that the tipping moment during the lasting is largely avoided.

SUMMARY OF THE INVENTION

An object of the invention is to mount the heel support carrier in such a way that it can pivot about an axis which is substantially parallel to the supporting plane of the surface of a last support in contact with the sole of a last at the tip end thereof and the axis is substantially perpendicular to the longitudinal direction of the heel support carrier holding at last gripped by a chuck. This allows the heel support carrier to always be adjusted substantially parallel to the force acting upon the last during lasting, so that the tipping moment is largely avoided. In addition, adjustment of the angular position of the heel support carrier corresponding to the line of force acting upon the last helps assure that the height of the heel support need not be adjusted for lasts of different sizes as long as the line of force remains the same. This results in a considerable simplification of the lasting operation.

The axis about which the heel support carrier can be pivoted is positioned vertically below the last support in the immediate proximity of the tip of the last. In this way, the inclination of the heel support carrier can be adapted to the direction of the force on the last in the most simple manner.

Preferably, the heel support carrier can be clamped in a predetermined angular position in relation to the last support. To this end, the heel support carrier can, for example, be adjusted by means of a spindle, or it can be adjusted and clamped upon a support arm secured to the machine by means of a slot in a part of the heel support carrier and a clamping lever screwed on a bolt extending from the support arm through the slot.

Advantageously, a dial is assigned to the angular position of the heel support carrier with which the heel support carrier can be set to a predetermined line of force acting upon the last during the lasting operation.

Preferably, this dial is mounted on a part of the heel support carrier which also has the slot.

In one embodiment of the present invention, the heel support on the heel support carrier is adjusted substantially parallel to the force acting in the longitudinal direction of the last during the lasting. Adjustment of the heel support is performed by moving the heel support along the heel support carrier by means of a motor designed, for example, as a propeller pitch-operating cylinder.

Advantageously, a slide connected to the heel support is mounted on the heel support carrier. The slide is designed essentially as a longitudinal member, so that it can move in a longitudinal direction.

A provision can also be made for mounting the heel support on the heel carrier in a way which allows vertical adjustment of the heel support with respect to the heel support carrier, such that the heel support can be placed in the best possible position in relation to the heel portion of the last.

BRIEF DESCRIPTION OF THE DRAWINGS

Other objects, features and advantages of the present invention will be better understood from the following description in conjunction with the accompaying drawings, wherein:

FIG. 2 is a schematic side view of the different directions of the line of force acting on the last during the lasting for two lasts of the same dimensions which are gripped between a stop and a heel support differently.

FIG. 3 shows substantially the same direction of the force for two lasts with different dimensions, but gripped between a stop and a heel support in the same manner.

FIG. 4 shows a section through the heel support carrier taken along the line I—I in FIG. 1.

DETAILED DESCRIPTION

Figure 1:
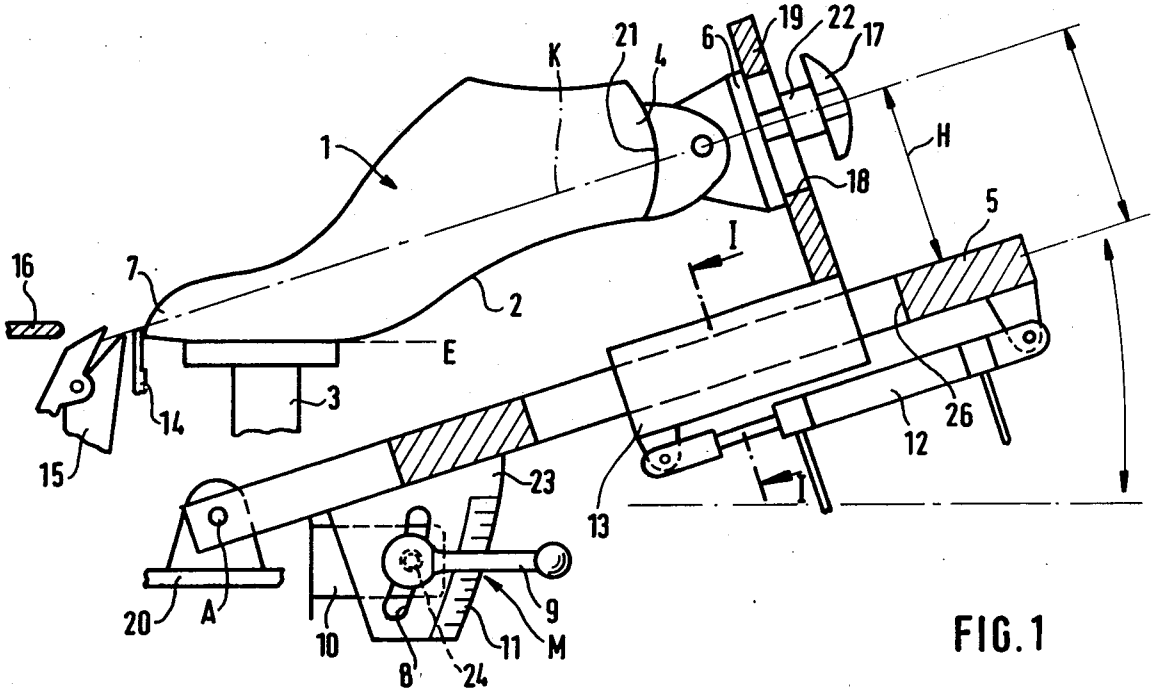
FIG. 1 is a schematic side view of a last support embodying the invention.

In the supporting device depicted in the figures, at last 1 is supported by a last support 3 with the sole of a tip end of a last lying in a supporting plane E. The last 1 abuts with its tip 7 on a stop 14, and a heel support 6 with an abutment face 21, adapted or adaptable to the shape of the heel portion 4, is placed on the heel portion 4 of the last. One or more grippers 15 are shown ahead of the tip 7 of the last, with which the leg of a shoe upper is pulled out over the last 1 at the lower edge thereof before the lasting edge is last by the wipers 16.

During lasting, a force acts on the last, preferably in the longitudinal direction K. This force is absorbed by the heel support 6. The heel support is made up of a stationary part and a part forming the abutment face 21. The part forming the abutment face is pivotable about a horizontal axis and is mounted on a heel support carrier 5 which extends in the longitudinal direction of the last 1. The heel support is also adjustable vertically by means of a threaded bolt 22 onto which is screwed a machine knob 17 with a female thread so as to enable the heel support 6 to be clamped at a given height setting on a projection 18.

The heel support carrier 5, designed as a longitudinal member (see FIG. 4) is hinged at its front end on a swivel bearing 20 secured to a machine frame which enables the heel support carrier 5 to pivot about a horizontal axis A which is parallel to plane E and perpendicular to the longitudinal direction of the heel support carrier. Viewed in the longitudinal direction of the heel support carrier 5, the axis A lies vertically below the last support 3 in the immediate proximity of the tip 7 of the last, so that the longitudinal axis of the heel support carrier 5 can be simply set substantially parallel to the direction K of the force acting on the last 1. To this end, the heel support carrier 5 can be adjusted in angular position by means of a part 23 with an arcuate slot 8 extending in a swivel direction of the heel support carrier 5. A threaded bolt 24 is mounted on a support arm 10, which is secured to the machine, and the bolt 24 extends through the slot 8 in parts 23. A clamping lever 9 is screwed onto the threaded bolt 24, whereby the heel support carrier 5 can be clamped in a preselected angular position in relation to the last support 3. The part 23 carries a dial 11, which indicates the angular position of the heel support carrier 5 in relation to a mark affixed to the machine.

A slide 13 is mounted to move in a recess 26 of the heel support carrier 5. The vertically protruding projection 19, to which is attached the heel support 6, is mounted on the slide 13 which allows the heel support to be moved toward and away from the last support 3. The longitudinal movement of the slide 13 allows the heel support to be adapted to the size of the last 1. Movement of slide 13 is effected by means of a motor 12 which, in the example shown, is designed as a hydraulic or pneumatic propeller pitch-operating cylinder, attached at its rear end to the rear end of the heel support carrier 5 and at its front end to the front end of the slide 13.

FIG. 2 illustrates the different directions of the line of force $K_1$ and $K_2$ for the two lasts $1_1$ and $1_2$ upon which the forces due to lasting act differently. By means of the novel arrangement of the swivel bearing on the heel support carrier 5, the heel support carrier 5 can be adjusted substantially parallel to the direction of force corresponding to the orientation of the last due to gripping between the stop 14 and the heel support 6 so that tipping moments on the last 1 are largely avoided during lasting. Due to the angular adjustment of the heel support carrier 5 to correspond with the direction of the force caused by lasting, a separate vertical adjustment of the heel support 6 is unnecessary when changing from one last to another having the same size but with a different orientation due to clamping.

FIG. 3 shows that the direction K of the force acting on the last remains essentially the same for lasts $1_1$ and $1_2$ of differing sizes but gripped between the stop 14 and the heel support 6 in identical fashion. Therefore, the angular position of the heel support carrier 5 does not have to be changed when exchanging one last for another last having a different size but wiped in the same manner. The heel support 6 is merely adjusted to the heel portion 4 of the last 1 by means of the motor 12.

What is claimed is:

1. A device for supporting a last on a toe lasting machine comprising:

last support means, adapted to be supported on a lasting machine frame, said last support means for supporting a last near the tip end thereof with a sole portion of the last facing in a downward direction, said last support means having a support surface extending in a plane; and heel support means adapted to be supported on the lasting machine frame, said heel support means including a heel support carrier which extends in a longitudinal direction, said heel support means further including a heel support, said heel support having an abutment face which is shaped to substantially the shape of a heel portion of the last, said heel support being mounted for movement along said heel support carrier towards and away from said last support means for adjustment of the distance between said last support means and said heel support, said heel support carrier being pivotable about an axis, said axis being vertically below said last support means, said axis being parallel to said plane and said axis being perpendicular to said longitudinal direction of said heel support carrier, whereby said heel support carrier may be pivoted to an angular position such that said heel support is substantially parallel to a force acting in a longitudinal directon of the last during a lasting operation.

2. The device of claim 1, wherein said heel support carrier includes means to fix said heel support carrier in a desired angular position relative to said last support means.

3. The device of claim 1, wherein said heel support carrier further includes spindle means for fixing said heel support carrier in a desired angular position.

4. The device of claim 1, wherein said heel support carrier includes means for fixing the angular position of said heel support carrier, said fixing means including a part on said heel support carrier, said part having an arcuate slot receiving a threaded bolt which is adapted to be fixedly attached to the lasting machine frame, said fixing means further including a clamping lever screwed on said bolt for clamping said part and thereby clamping said heel support carrier in a preselected angular position.

5. The device of claim 1, further comprising dial means for indicating the angular position of said heel support carrier, said dial means having marks which correspond to different angular positions of said heel support carrier relative to said last support means.

6. The device of claim 5, wherein said dial means is disposed on a part which extends from said heel support carrier.

7. The device of claim 1, further comprising motor means for adjusting the distance between said heel support and said last support means, said motor means being disposed on said heel support carrier, whereby said heel support is adjustable substantially parallel to the directon of a force acting in the longitudinal direction of the last held by said last support means and said heel support means during a lasting operation.

8. The device of claim 1, further including a slide fixedly attached to said heel support and movably mounted on said heel support carrier, whereby said heel support is slidable in the longitudinal direction of said heel support carrier.

9. The device of claim 1, further comprising means for adjusting the distance between said heel support and said heel support carrier, whereby said heel support can be placed in a suitable position in relation to the heel portion of the last.

10. A device for supporting a last on a toe lasting machine comprising:

last support means, adapted to be supported on a lasting machine frame, for supporting a last near the tip end thereof with a sole portion of the last facing in a downward direction, said last support means having a support surface extending in a plane;

heel support means adapted to be supported on the lasting machine frame, said heel support means including a heel support carrier which extends in a longitudinal direction, said heel support means further including a heel support, said heel support having an abutment face which is shaped to substantially the shape of a heel portion of the last, said heel support being mounted for movement along said heel support carrier towards and away from said last support means for adjustment of the distance between said last support means and said heel support, said heel support carrier being pivotable about an axis, said axis being vertically below said last support means, said axis being parallel to said plane and said axis being perpendicular to said longitudinal direction of said heel support carrier;

means for fixing the angular position of said heel support carrier, said fixing means including a part on said heel support carrier, said part having an arcuate slot receiving a threaded bolt which is adapted to be fixedly attached to the lasting machine frame, said fixing means further including a clamping lever screwed on said bolt for clamping said part and thereby clamping said heel support carrier in a preselected angular position; and motor means for adjusting the distance between said heel support and said last support means, said motor means being disposed on said heel support carrier;

whereby said heel support may be moved longitudinally along said heel support carrier and said heel support carrier may be pivoted to an angular position such that the heel support is substantially parallel to a force acting in a longitudinal direction of the last during a lasting operation.

11. A device for supporting a last on a toe lasting machine comprising:

last support means, adapted to be supported on a lasting machine frame, for supporting a last near the tip end thereof with a sole portion of the last facing in a downward direction, said last support means having a support surface extending in a plane;

heel support means adapted to be supported on the lasting machine frame, said heel support means including a heel support carrier which extends in a longitudinal direction, said heel support means further including a heel support, said heel support having an abutment face which is shaped to substantially the shape of a heel portion of the last, said heel support being mounted for movement along said heel support carrier towards and away from said last support means for adjustment of the distance between said last support means and said heel support, said heel support carrier being pivotable about an axis, said axis being vertically below said last support means, said axis being parallel to said plane and said axis being perpendicular to said longitudinal direction of said heel support carrier;

means for fixing the angular position of said heel support carrier, said fixing means including a part on said heel support carrier, said part having an arcuate slot receiving a threaded bolt which is adapted to be fixedly attached to the lasting machine frame, said fixing means further including a clamping lever screwed on said bolt for clamping said part and thereby clamping said heel support carrier in a preselected angular position;

a slide, said slide being movably mounted on said heel support carrier and said heel support being fixedly attached to said slide;

motor means for adjusting the distance between said heel support and said last support means, said motor means being disposed on said heel support carrier and connected to said slide for moving said slide along the longitudinal directon of said heel support carrier; and means for adjusting the distance between said heel support and said heel support carrier;

whereby said heel support may be moved longitudinally along said heel support carrier and said heel support carrier may be pivoted to an angular position such that the heel support is substantially parallel to a force acting in a longitudinal direction of the last during a lasting operation.

* * * * *